US006554900B1

(12) United States Patent
Aydin et al.

(10) Patent No.: US 6,554,900 B1
(45) Date of Patent: Apr. 29, 2003

(54) DEVICE AND METHOD FOR APPLYING A FLOWABLE MEDIUM ONTO A MOVING SURFACE

(75) Inventors: Oral Aydin, Mannheim (DE); Andree Dragon, Speyer (DE); Frank Reinhard, Mannheim (DE)

(73) Assignee: Pagendarm Technologie GmbH, Halstenbek (DE)

( * ) Notice: Subject to any disclaimer, the term of this patent is extended or adjusted under 35 U.S.C. 154(b) by 0 days.

(21) Appl. No.: 09/787,924

(22) PCT Filed: Sep. 30, 1999

(86) PCT No.: PCT/EP99/07242

§ 371 (c)(1),
(2), (4) Date: Apr. 2, 2001

(87) PCT Pub. No.: WO00/20123

PCT Pub. Date: Apr. 13, 2000

(30) Foreign Application Priority Data

Oct. 2, 1998 (DE) ..... 198 45 427
Jun. 14, 1999 (DE) ..... 199 26 956

(51) Int. Cl.[7] ..... B05C 1/08

(52) U.S. Cl. ..... 118/211; 118/212; 118/411; 118/412; 118/413; 118/414; 118/419

(58) Field of Search ..... 118/410, 411, 118/419, 412, 413, 414, 211, 212

(56) References Cited

U.S. PATENT DOCUMENTS 5,366,551 A 11/1994 Aidun ..... 118/411
5,665,163 A 9/1997 Li et al. ..... 118/413
5,735,957 A 4/1998 Becker et al. ..... 118/411

FOREIGN PATENT DOCUMENTS

DE 1 176 528 8/1964

*Primary Examiner*—Laura Edwards
(74) *Attorney, Agent, or Firm*—Oblon, Spivak, McClelland, Maier & Neustadt, P.C.

(57) ABSTRACT

An apparatus for the application of a flowable medium (2, 2') from a stock chamber (7, 8) to a surface (6) being moved along the apparatus, and to the use of an apparatus of this type. The stock chamber (7, 8) partly covers the surface (6), with formation of a sealing gap (14) and an exit gap (18). In order to prevent the formation of air bubbles in the medium (2, 2'), it is proposed to divide the stock chamber (7, 8) into a pre-chamber (7) and a main chamber (8). A dividing element (10) which, together with the surface (6), limits a dividing gap (15), is arranged between the chambers. Various shapes of the dividing element are proposed. The apparatus is particularly suitable for the application of a polymer dispersion to the surface (6). A process for operating an apparatus of this type is also described.

5 Claims, 8 Drawing Sheets

DEVICE AND METHOD FOR APPLYING A FLOWABLE MEDIUM ONTO A MOVING SURFACE

Figure 1:
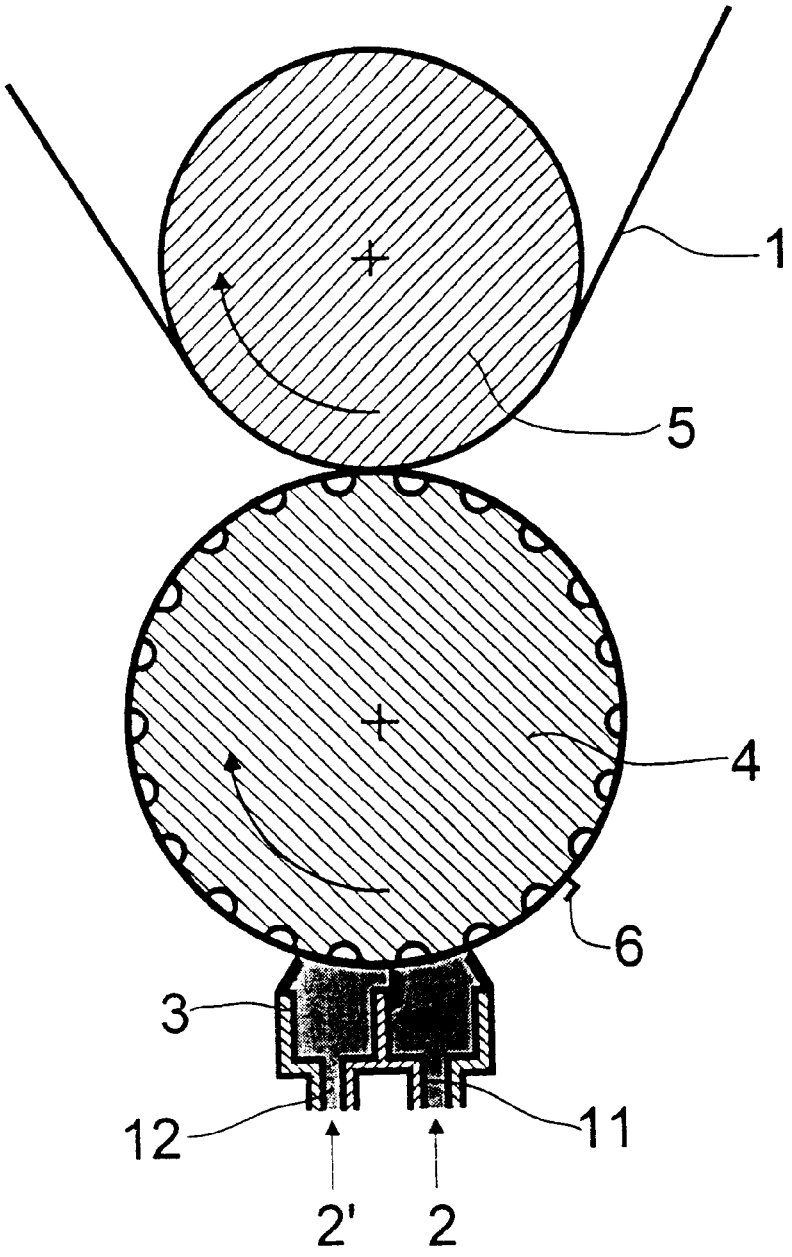

The invention relates to an apparatus and a process for the application of a flowable medium from a stock chamber to a surface moved along the apparatus, where the stock chamber partly covers the surface with formation of a sealing gap and an exit gap. The invention furthermore relates to the use of an apparatus of said type.

Apparatuses of said type are widely employed, for example, in the production of labels for coating paper or film webs with adhesives. A common process for this purpose is the engraved roll application process, in which the flowable adhesive is located in an open stock chamber whose opening is in contact with a rotating roll. The roll contains a multiplicity of engraved grooves. During rotation of the roll, the initially empty grooves enter the opening region of the stock chamber from the outside and are filled with adhesive therein. On exit of the roll from the opening region of the stock chamber, excess adhesive is wiped off the surface of the roll by means of a doctor blade which extends over the width of the roll and limits the opening region of the stock chamber. During further rotation of the roll, the latter is brought into contact with the paper or film web to be coated, causing at least some of the adhesive in and on the grooves to be transferred to the web.

The amount of adhesive transferred from the stock chamber to the roll can be varied within narrow limits through the position or contact pressure of the doctor blade at the exit of the roll from the opening region of the stock chamber, i.e. ultimately through the height of the exit gap formed by the doctor blade and the roll surface.

A further doctor blade is generally installed in the region of the entry of the roll into the opening region of the stock container, this further doctor blade taking on the function of a seal between the stock container and the roll surface. In order to prevent excess outflow of the adhesive at this point, the sealing gap formed between this doctor blade and the roll surface must have the smallest possible height.

The contact pressure of the doctor blade at the sealing gap and the height of the exit gap can be adjusted in this known process by changing the position and situation of the application apparatus relative to the rotating roll.

In particular at high roll rotation speeds, complete filling of the roll grooves is no longer guaranteed in this known process, which results in the amount of adhesive taken up during a rotation and thus ultimately the application weight of the adhesive to the web to be coated dropping in an undesired manner. Furthermore, air is increasingly introduced into the stock container through the roll grooves at higher rotation speeds, resulting in undesired foaming in the stock container. The presence of foam in the stock container in turn means that the grooves of the engraved roll are not completely filled with adhesive, but instead partly with air in the form of bubbles, which means that fine bubbles form on the web to be coated, resulting in undesired clouding of the adhesive layer.

In order to prevent said difficulties, it has been proposed to pressurize the adhesive in the stock chamber using suitable means (J. Türk, H. Fietzek, H. Hesser and I. Voges, Perspektiven für die Verarbeitung von Dispersionshaftklebstoffen, reprint TI/ED 1654d, BASF Ludwigshafen, August 1993). This ensures complete filling of the engraved grooves, even at high roll rotation speeds. Depending on the set pressure, a different amount of adhesive is also conveyed out of the application apparatus on the surface of the roll outside the engraved grooves at the exit gap. In this way, the amount of adhesive applied to the roll and thus ultimately the application weight of the adhesive on the web to be coated can be set within a broader range than without the use of pressure. Due to the higher pressure in the stock chamber, it is furthermore achieved that only a greatly reduced amount of air is introduced into the stock container at the sealing gap; in this way, excess foaming is prevented.

However, the higher the roll rotation speed, the higher the pressure in the stock chamber has to be selected in order to prevent the introduction of air into the adhesive. The maximum achievable rotation speed is limited by the fact that, on a further increase in pressure, the adhesive is forced out of the stock container in an uncontrolled manner firstly through the sealing gap and secondly through the exit gap. Exit of adhesive through the sealing gap results in undesired presentation of adhesive in front of this gap, which can result in soiling of the environment of the application apparatus and in operational interruptions. Uncontrolled exit of adhesive through the exit gap in turn results in uneven application of composition to the web to be coated.

In the article "Rasterwalzenauftragsverfahren mit Druckkammerrakel—ein Beschichtungswerkzeug auch für strahlenchemisch härtende Systeme", IPW 1/97, pp. 1 to 8, it was proposed to construct an application apparatus in such a way that the adhesive flows constantly through the stock chamber in the opposite direction to the direction of movement of the roll. In this way, air introduced into the stock container is constantly transported away by the rotating roll with the flowing adhesive. It was also proposed in this article to incorporate a throttle element into the stock chamber in such a way that a narrow throttle gap with a length of a few centimeters forms between the throttle element and the roll surface, through which gap the adhesive flows in the opposite direction to the direction of movement of the roll surface. In this way, the engravings are filled better with adhesive, and any air present in the engraved grooves is forced out of them, at least partly, and removed from the roll surface with the flowing-off adhesive. In practice, however, precise adjustment of the throttle element independently of the operating parameters, for example roll rotation speed, viscosity and pressure of the adhesive, proves to be difficult and not easily reproducible. In addition, an apparatus of this type cannot reliably prevent the introduction of air into the stock chamber and the formation of bubbles in the adhesive film.

It is an object of the present invention to provide an apparatus for the application of a flowable medium to a surface moved along the apparatus which works reliably even at high surface speeds, in which formation of air bubbles in the medium is reliably prevented, which is of simple construction, and which can be set simply and reproducibly for given operating conditions.

We have found that this object is achieved by an apparatus for the application of a flowable medium from a stock chamber to a surface being moved along the apparatus, where the application chamber at least partly covers the surface. In accordance with the invention, the stock chamber is divided into a pre-chamber and a main chamber, between which is arranged a dividing element which, together with the surface, limits a dividing gap.

The dividing element arranged between the pre-chamber and the main chamber reliably prevents air which has entered the pre-chamber from being transported into the main chamber and resulting in undesired foaming therein. The actual coating of the surface with the desired amount of the flowable medium then takes place free from air bubbles in the main chamber. The pre-chamber and the main chamber advantageously have independent feeds for the medium, so that, for example, the pressure conditions in the pre-chamber and in the main chamber can be selected independently of one another.

Particular advantages arise if the dividing element is arranged in such a way that it touches the surface. This achieves complete separation of the pre-chamber and the main chamber.

In practice, complete touching or contact of the dividing element with the surface can often only be achieved if the surface is stationary. In actual operation, i.e. in the case of a moving surface, unavoidable variations in the guidance of the surface mean that a certain, albeit very small gap height will usually be present. Particularly effective prevention of air bubbles and uniform application of the medium to the surface is also achieved if the dividing element is arranged in such a way that the height of the dividing gap between the dividing element and the surface is between 0 and 0.1 mm, in particular between 0 and 0.08 mm, preferably between 0 and 0.05 mm, particularly preferably between 0 and 0.02 mm. A minimization of the height of the dividing gap in this way likewise achieves effective separation of the pre-chamber and the main chamber.

In order to ensure reliable function of the apparatus under various operating conditions, it is advantageous for the dividing element to be arranged in a movable manner. Movement can consist both in a change in the situation of the dividing element, for example a tilting, a movement in or against the direction of movement of the surface or a movement toward or away from the surface, i.e. a change in the height of the dividing gap. Operating conditions which influence the optimum position and situation of the dividing element can be, for example, the nature and speed of movement of the surface, the pressure of the medium in the pre-chamber, the pressure of the medium in the main chamber, and the composition and viscosity of the medium to be applied.

Simple implementation of the separation of the pre-chamber and the main chamber arises if the dividing element contains a doctor blade. However, other embodiments of the dividing element are also conceivable. Particularly effective separation can be achieved if the dividing element is a double doctor blade. An essential prerequisite for the choice of a suitable dividing element is its sealing function separating the pre-chamber from the main chamber.

In an advantageous embodiment, the dividing element contains a cylindrical rod. This facilitates reliable and low-wear sealing between the pre-chamber and the main chamber.

Effective sealing can also be achieved if the dividing element contains a flexible leaf which is arranged in such a way that at least one edge of the leaf touches the surface in a resilient manner.

Particularly effective sealing between the pre-chamber and the main chamber can advantageously be achieved by designing and arranging the dividing element in such a way that it, together with the moving surface, limits at least two dividing gaps, where the height of each dividing gap is between 0 and 0.1 mm, in particular between 0 and 0.08 mm, preferably between 0 and 0.05 mm, particularly preferably between 0 and 0.02 mm. In a particularly preferred embodiment, the dividing element is arranged in such a way that the height of each dividing gap is 0 mm, i.e. the dividing element touches the moving surface.

The division of the stock chamber into a pre-chamber and a main chamber enables individual operating parameters to be modified separately for the pre-chamber and for the main chamber. In an advantageous embodiment of the invention, means are present with which the pressure of the medium in the main chamber can be set independently of the pressure of the medium in the pre-chamber. For example, the pressure in the main chamber can then be chosen to be higher than the pressure in the pre-chamber. This firstly avoids the medium being forced out of the pre-chamber in an uncontrolled manner through the sealing gap which seals off the pre-chamber from the outside, and secondly the increased pressure in the main chamber forces any air bubbles which pass through the dividing gap back into the pre-chamber.

Inverse pressure conditions in the pre-chamber and in the main chamber can offer particular advantages. In an advantageous process for operating the apparatus according to the invention, the pressure of the medium in the pre-chamber is higher than the pressure of the medium in the main chamber. In this way, penetration of air into the pre-chamber through the sealing gap can be effectively prevented from the outset. The pressure in the main chamber can then be varied within broad limits without the risk of foaming, in order to guarantee optimum layer application to the surface.

Further advantages arise if a throttle gap is additionally arranged between the pre-chamber and the main chamber. The throttle gap can be located between the pre-chamber and the dividing element or between the dividing element and the main chamber. The height of the throttle gap is always larger than that of the dividing gap. A throttle gap of this type can, for example, be formed by a region of the wall between the pre-chamber and the main chamber which is designed in such a way that it runs parallel to the moving surface at a small distance therefrom. It is furthermore conceivable for a special throttle element to be installed on the wall between the pre-chamber and the main chamber. The dividing element limiting the dividing gap can in this case be attached to the throttle element. The throttle element can be arranged so as to be adjustable in position and/or situation. In this way, the height and shape of the throttle gap can be changed. The length of the throttle gap can vary within broad limits. In particular, a conceivable throttle gap is one whose length is a multiple of the length of the dividing gap. The throttle gap can be directly adjacent to the dividing gap, but can also be arranged spatially separated therefrom. An important action of the throttle gap is to reduce the pressure difference between the pre-chamber and the main chamber. In this case, the throttle gap fulfils a sealing function supporting the function of the dividing gap. If, for example, the pressure in the main chamber is chosen to be higher than the pressure in the pre-chamber, a pressure gradient forms in the throttle gap, with the pressure dropping from the main chamber to the pre-chamber. Any air bubbles which have penetrated from the pre-chamber into the throttle gap are in this way additionally held back in the throttle gap.

Further advantages arise if means are present which allow the temperature of the medium in the pre-chamber, in the main chamber or in both chambers to be set independently of the ambient temperature. Thus, for example, the temperature in both chambers can be chosen to be significantly higher than the ambient temperature. This enables firstly the viscosity of the medium to be reduced and thus its flow properties to be improved, and secondly a drying process following application of the medium to the surface is accelerated.

Particular advantages arise if the temperature of the medium in the main chamber is selected to be higher than that of the medium in the pre-chamber. This reduces the viscosity of the medium in the main chamber compared with the viscosity of the medium in the pre-chamber, which facilitates penetration of small amounts of the medium from the main chamber into the pre-chamber through the dividing gap, but makes transport of the medium—and thus also of any air bubbles present—from the pre-chamber into the main chamber more difficult. Conversely, it is also conceivable to select the temperature in the pre-chamber higher than in the main chamber. This reduces the viscosity of the medium in the pre-chamber, which increases the sealing function of the sealing gap and can effectively prevent penetration of air into the pre-chamber from the outside. The temperature in the main chamber can then be selected independently of the temperature in the pre-chamber in such a way that optimum composition application to the surface is ensured.

Particularly reliable and uniform composition application occurs in the case where the moving surface has recesses, i.e., for example, is in the form of an engraved roll. The term engraved roll is taken to mean a cylindrical roll in which fine grooves have been engraved at regular intervals. However, the recesses can also be punctiform or have any other geometrical shape desired. The profile of the recesses can also adopt any desired forms, for example rectangular or circular.

The apparatus according to the invention is suitable for the application of media of a wide variety of types to the surface, for example polymer melts, solutions of polymers in organic solvents or dispersions of a wide variety of types. Particular advantages arise on use of the apparatus according to the invention for the application of a polymer dispersion to the surface. In contrast to a homogeneous solution, a dispersion is a heterogeneous mixture of a liquid dispersion medium and a dispersed substance finely distributed therein. Of particular practical importance here are dispersions in which the dispersion medium is water and the dispersed substance consists of polymer particles. A dispersion of this type is also referred to as an aqueous polymer dispersion. Aqueous polymer dispersions are widely used as adhesives in the production of labels.

The apparatus according to the invention is particularly suitable for the application of a contact adhesive dispersion to the surface. The term contact adhesive dispersion is taken to mean a dispersion which comprises a pressure-sensitive and self-adhesive polymer whose film formation temperature is below room temperature. The film formation temperature is the temperature at which the dispersed particles melt together to form a transparent, crack-free film. A low film formation temperature can be achieved if a soft polymer, i.e. a polymer having a low glass transition temperature, or a hard polymer to which a plasticizer has been added as additive is used. Polymers based on acrylates and/or methacrylates dispersed in water as dispersion medium are widely used here.

Figure 2:
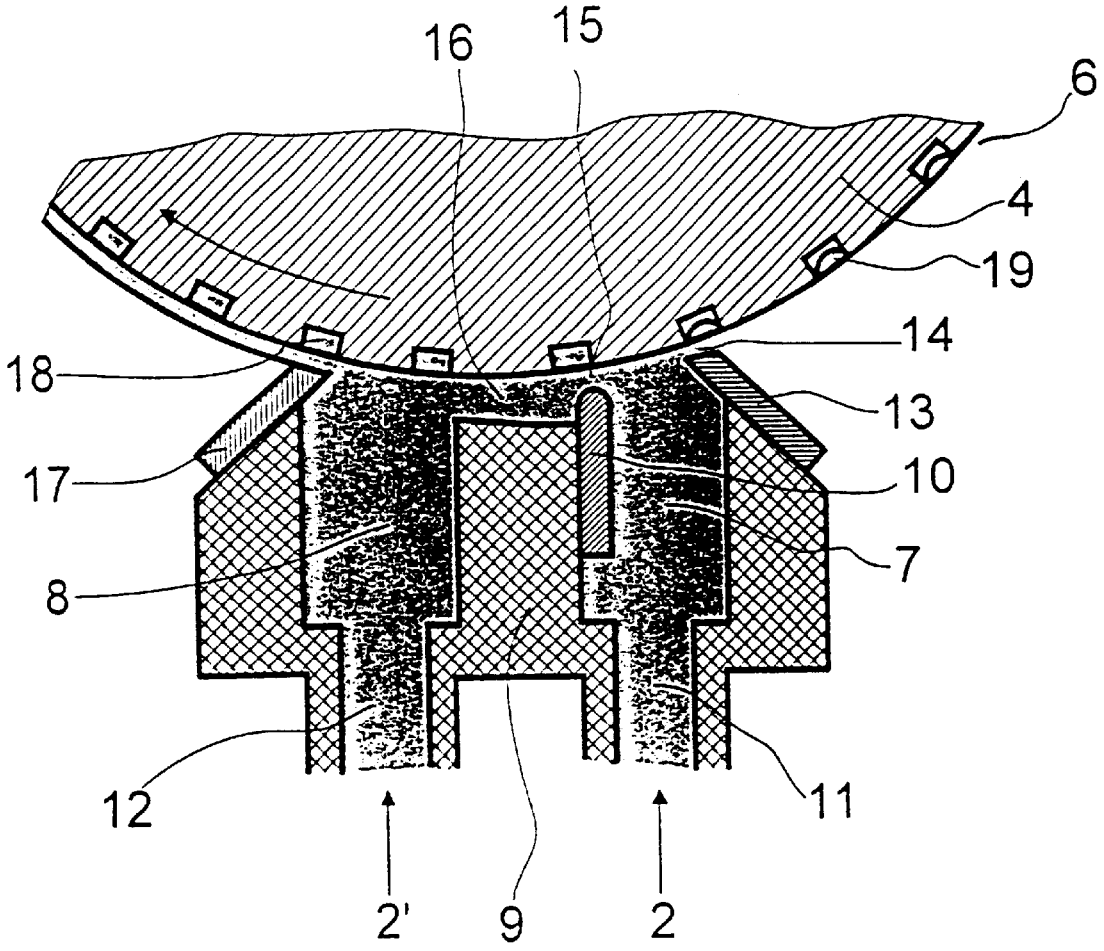
Figure 6:
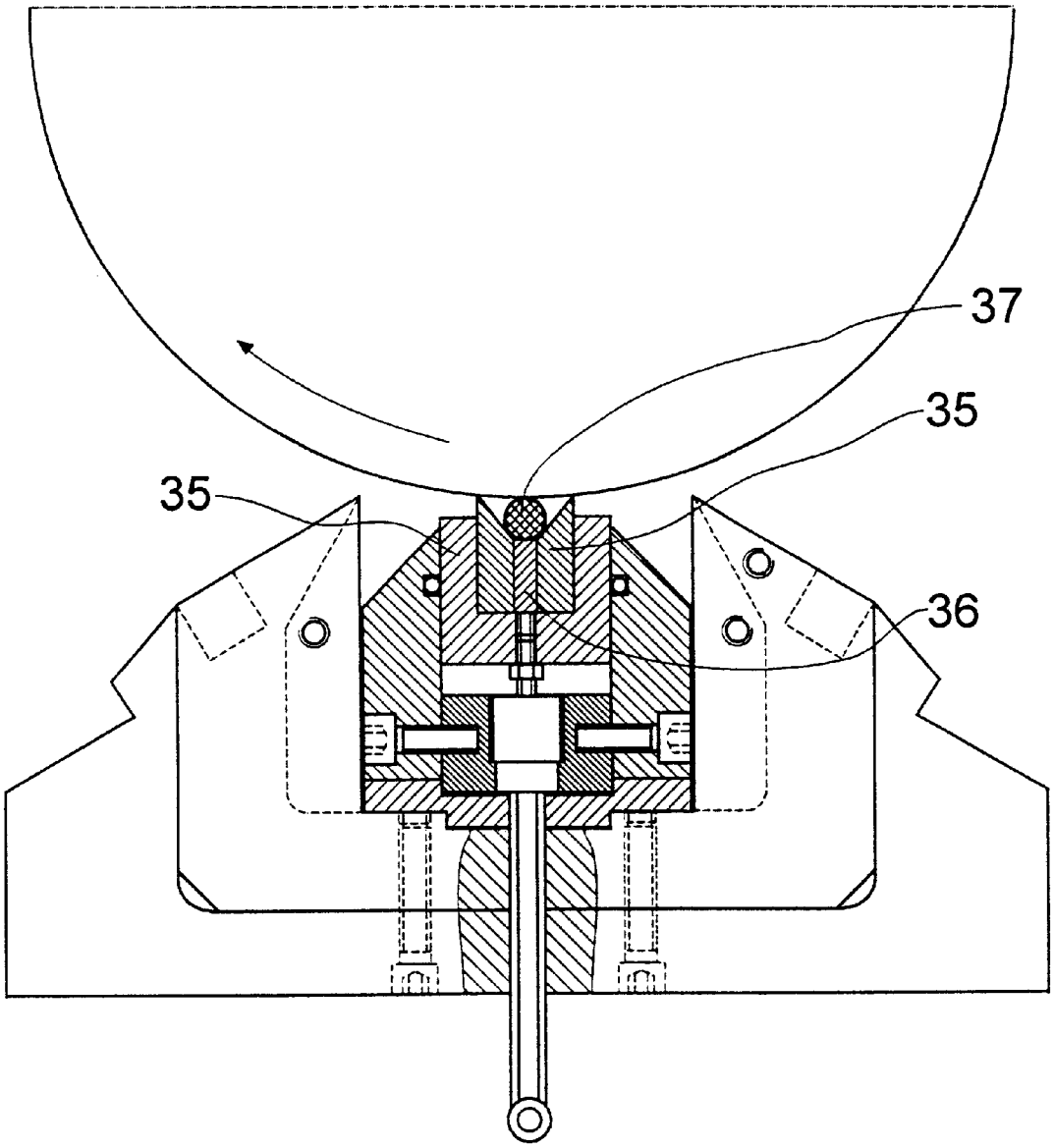
Figure 7:
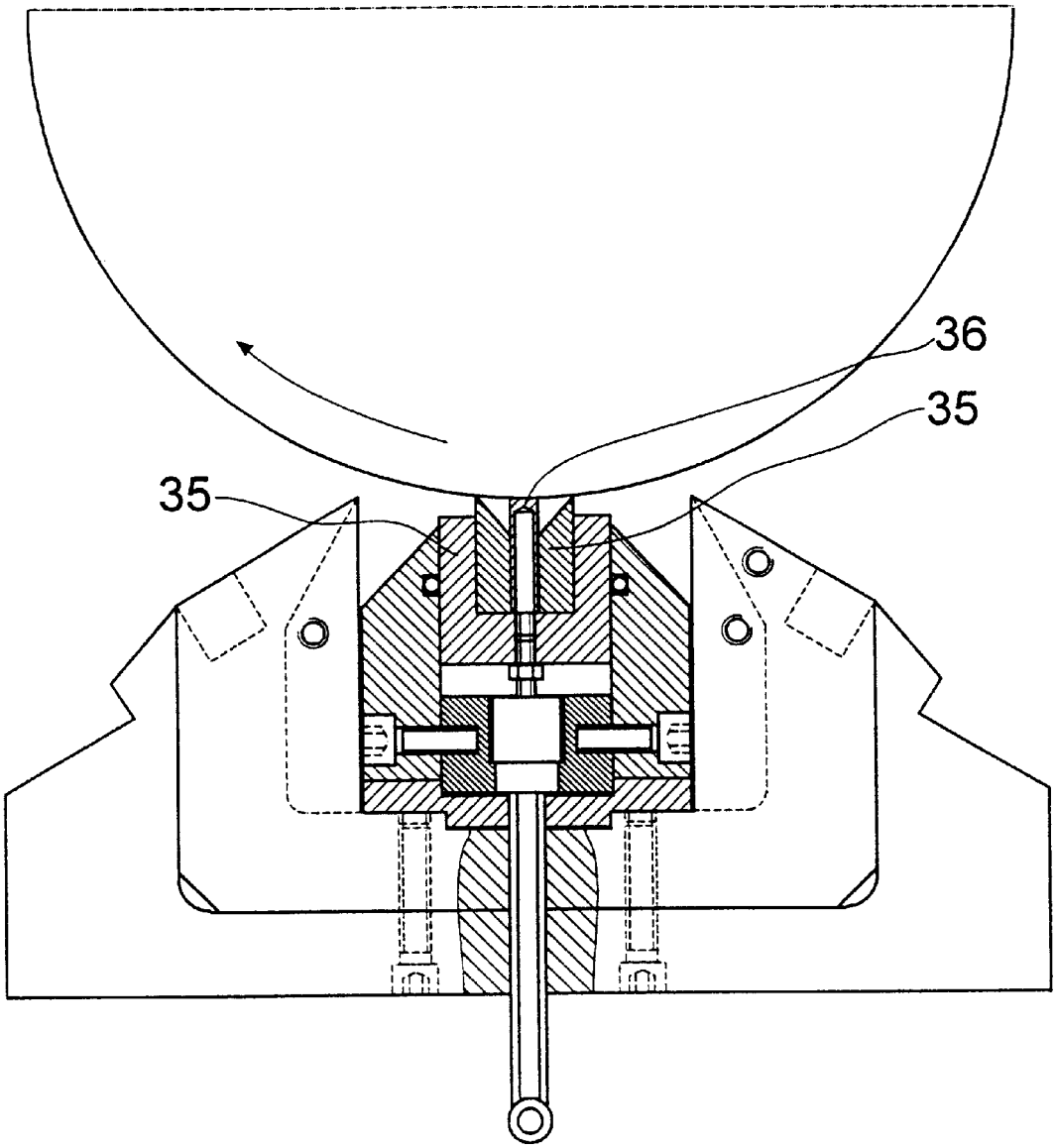
Figure 8:
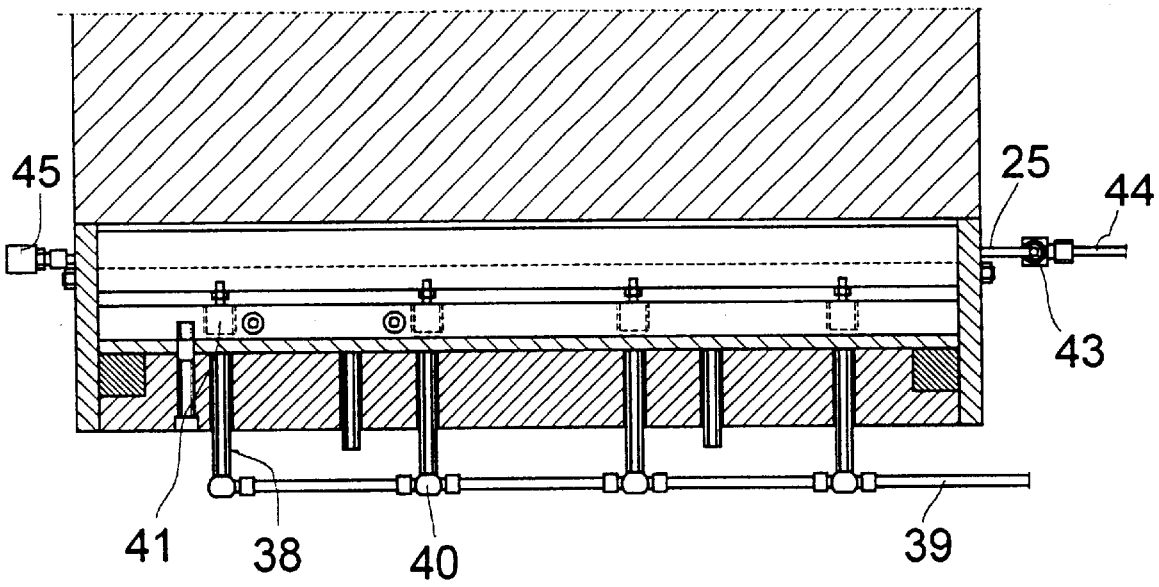

Preferred embodiments of the invention are explained in greater detail below with reference to the drawing, in which FIG. 1 shows a sketch of the principle of an apparatus according to the invention for coating a web with a flowable medium, FIG. 2 shows a diagrammatic sectional side view of an application apparatus according to the invention, FIGS. 3 to 7 show sectional side views of various variants of an application apparatus according to the invention, and FIG. 8 shows a sectional front view of an application apparatus according to the invention.

List of Reference Numerals

1 web
2,2' flowable medium
3 application apparatus
4 engraved roll
5 counterroll
6 surface
7 pre-chamber
8 main chamber
9 dividing wall
10 central doctor blade
11 opening of the pre-chamber
12 opening of the main chamber
13 front doctor blade
14 sealing gap
15 dividing gap
16 throttle gap
17 rear doctor blade
18 exit gap
19 engraved groove
20 housing
21 filler piece
22 intermediate plate
23 strip
24 side strip
25 tubular gasket
26 lifting strip
27 plastic leaf
28 clamp strip
29 leaf carrier
30 doctor-blade holder
31 doctor-blade leaf
34 wiper
35 sealing strip
36 spacer strip
37 rod
38 pneumatic connection
39 pneumatic line
40 T-piece
41 lifting cylinder
43 distributor
44 compressed air pipe
45 sealing cap The apparatus shown diagrammatically in FIG. 1 for coating the web 1 with a flowable medium 2, 2' essentially consists of an application apparatus 3, an engraved roll 4 and a counterroll 5. The medium 2, 2' is applied to the surface 6 of the rotating engraved roll 4 in the application apparatus 3 and is transported to the web 1 by this roll. The web 1 is moved over the surface 6 of the engraved roll 4 by the counterroll 5 with exertion of pressure, during which the medium 2, 2' is transferred to the web 1 to be coated.

The application apparatus 3 shown diagrammatically in enlarged form in FIG. 2 has a stock chamber which is divided into a pre-chamber 7 and a main chamber 8 by a central doctor blade 10 as dividing element. The medium to be applied is fed, in each case separately, to the pre-chamber 7 and the main chamber 8 through openings 11, 12. The application apparatus 3 is covered by the rotating engraved roll 4, the surface 6 of the engraved roll 4 moving over the application apparatus 3 in a clockwise direction. A front doctor blade 13 limits the pre-chamber 7 at the point of entry of the roll surface 6 into the application apparatus 3, with formation of a sealing gap 14. The front doctor blade 13 thus satisfies the function of a sealing lip. The central doctor blade 10 together with the surface 6 limits a dividing gap 15. Furthermore, the dividing wall 9 together with the surface 6 limits a throttle gap 16, whose height is significantly greater than that of the dividing gap 15 and whose length is a multiple of the length of the dividing gap 15. Finally, a rear doctor blade 17 limits the main chamber 8 in the region of the exit of the roll surface 6 from the application apparatus 3, with formation of an exit gap 18.

In operation, the medium 2, 2' is pumped through the opening 11 into the pre-chamber 7 and through the opening 12 into the main chamber 8 by means of pumps (not shown) . The pressure in the pre-chamber 7 and in the main chamber 8 is set, in each case separately, by means of regulation devices, for example reduction valves, which are not shown. In addition, a heating device may be provided in the line to the pre-chamber 7 and in the line to the main chamber 8 in order to set the temperature in the pre-chamber 7 and in the main chamber 8 separately.

The engraved roll 4 has on its surface 6 a multiplicity of recesses in the form of engraved grooves 19. The direction of the engraved grooves 19 on the surface 6 of the roll 4 has both an axial and a tangential component, relative to the roll axis. The tangential component here is generally significantly smaller than the axial component, i.e. the engraved grooves run helically with a slope which is generally a multiple of the width of the roll. The distance between the grooves on the surface is typically between 0.2 mm and 0.5 mm, depending on the desired application weight, and their depth and width are typically about 0.1 mm.

Before entry of the surface 6 into the application apparatus 3, a residual amount of the medium and a certain amount of air are present in the engraved grooves 19. The residual amount of the medium is introduced into the pre-chamber 7 of the application apparatus 3 through the sealing gap 14. The sealing gap 14 is designed in such a way that the amount of air introduced at the same time is kept minimal. This can be achieved, for example, by the front doctor blade 13 being pressed against the surface 6 of the engraved roll 4 with exertion of pressure.

A significant improvement in the sealing function arises through the pressure of the medium 2 in the pre-chamber 7 being selected higher than the ambient pressure. This causes a certain amount of the medium 2 to be transported constantly to the outside through the sealing gap 14, with the medium 2 expelling the air present in the engraved grooves 19. The medium in the sealing gap 14 thus forms a liquid barrier against ingressing air. The medium 2 exiting from the sealing gap 14 is collected in a trough (not shown in FIG. 2) and fed back into the processing circuit.

The excess pressure to be selected in the pre-chamber 7 is preferably less than 1 bar, in particular in the region of about 500 mbar. Particularly good results have been achieved with an excess pressure in the range from 300 to 600 mbar. If the pressure in the pre-chamber 7 is too high, the medium is forced to the outside excessively and in an uncontrolled manner through the sealing gap 14. This may be the case above 1000 mbar.

In order to prevent medium which is exiting through the sealing gap or elsewhere dropping onto the surface in an uncontrolled manner, it is advantageous to arrange the application apparatus 3, as shown in FIG. 1, vertically beneath the engraved roll 4 ("six o'clock position"). It is likewise advantageous to arrange the counterroll 5 vertically above the engraved roll 4 ("12 o'clock position").

In the pre-chamber 7, the engraved grooves 19 are completely filled with the medium 2. The engraved grooves 19 filled in this way are transported past the dividing gap 15 and the throttle gap 16 into the main chamber 8 by the rotation movement of the engraved roll. The central doctor blade 10 limiting the dividing gap 15 effectively holds back any air bubbles present in the pre-chamber 7.

The pressure in the main chamber 8 can be selected independently of the pressure in the pre-chamber 7. Thus, it is possible, in particular, to select the pressure in the main chamber to be lower than the pressure in the pre-chamber. Also particularly suitable here is an excess pressure of less than 1 bar compared with the outside. If the pressure in the main chamber 8 is too high, the medium is forced through the exit gap 18 to the outside in an uncontrollable manner, which results in uneven coating of the surface 6 of the engraved roll 4 and thus of the web 1 to be coated. A pressure in the range from 100 to 300 mbar has proven successful.

The ratio between the excess pressure in the main chamber 8 and the excess pressure in the pre-chamber 7 is preferably in the range from 1:2 to 1:10, particularly preferably in the range from 1:2 to 1:5. The higher pressure in the pre-chamber 7 effectively prevents foaming at the sealing gap 11 from the outset. The application weight can then be set through the (lower) pressure in the main chamber 8 independently of the pressure in the pre-chamber 7.

The dividing gap should have the lowest possible height. Complete contact of the central doctor blade 10 with the roll surface 6 is preferred. However, this frequently cannot be achieved in practice since the roll moves and a very small gap height is unavoidable due to vibrations and due to wear. It is appropriate in practice to select the height of the dividing gap 15 to be less than 0.1 mm, in particular less than 0.08 mm. Particularly good results are achieved with gap heights of less than 0.05 mm.

The surface 6 is coated uniformly with the medium 2' in the main chamber 8 under the pressure prevailing therein. The amount of medium 2' applied to the surface 4 is determined, inter alia, by the position of the rear doctor blade 17, which limits the exit gap 18. Depending on the position, a certain amount of the medium is also applied to the surface 6 of the engraved roll 4 between the engraved grooves 19.

In particular for the coating of a web or film with an aqueous polymer dispersion, it has proven successful to use plastic materials, such as polyethylene, as the material for the central doctor blade 10. The length of the dividing gap 15 is preferably less than 5 mm, in particular less than 2 mm. The length of the throttle gap between the dividing gap and the main chamber is preferably from 2 to 10 cm, in particular about 5 cm, and its height is preferably greater than 0.2 mm, in particular greater than 0.5 mm.

Specific embodiments of the apparatus according to the invention are shown in FIGS. 3 to 7. In these figures, components which are functionally identical are denoted by identical reference numerals, even if their detailed design is different.

Figure 3:
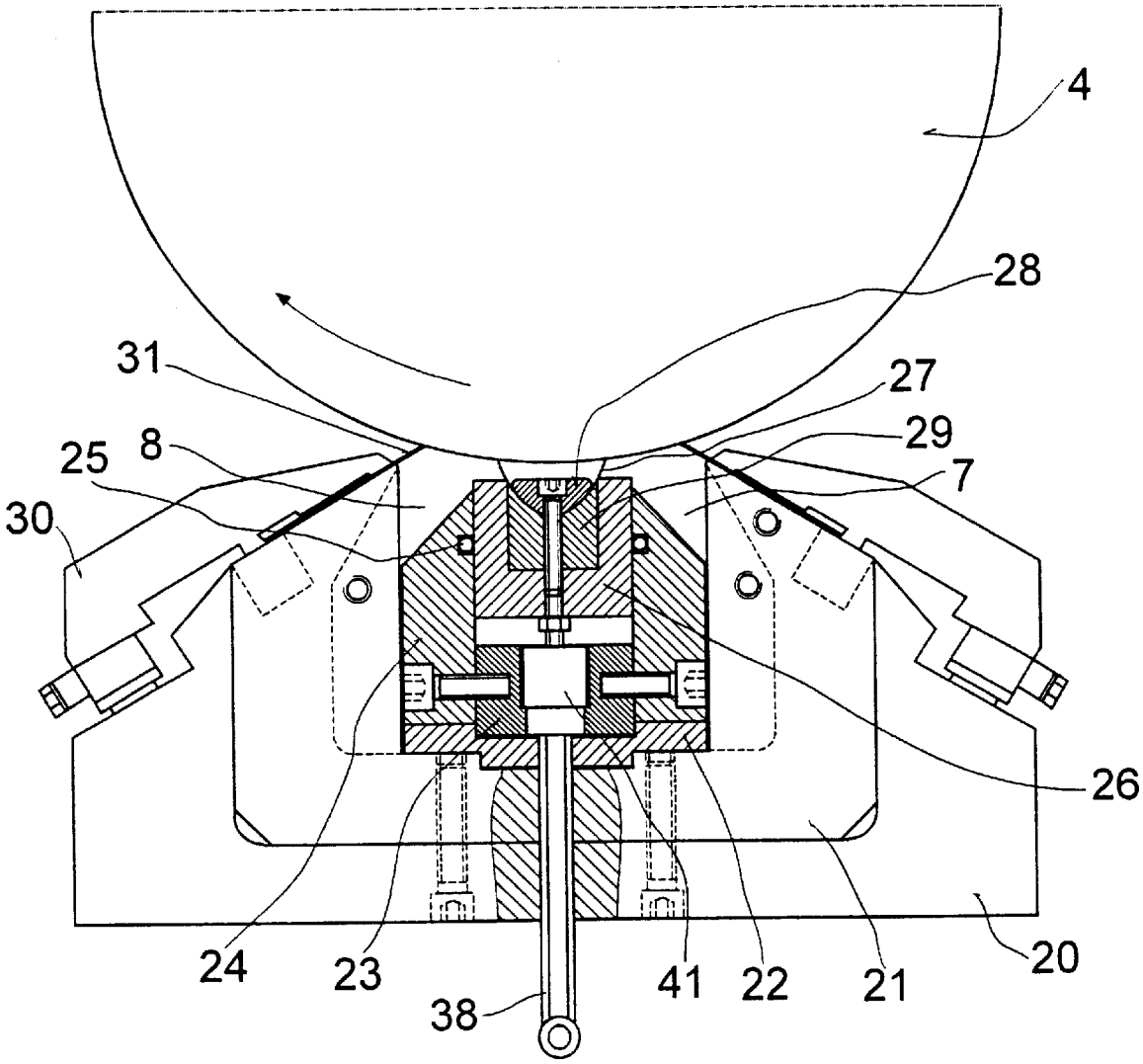

FIG. 3 shows a sectional side view of a particularly preferred application apparatus. A filler piece 21 is employed in the housing 20. An intermediate plate 22 on which two strips 23 are mounted is inserted into the filler piece. Side strips 24 are located on the left and right of the strips 23. These side strips have recesses in which gaskets 25 are located. A lifting strip 26 is run between the side strips 24. This lifting strip can be moved vertically through pneumatic means with the aid of lifting cylinders 41. In another embodiment, the vertical movement of the lifting strip 26 can also take place mechanically. A leaf carrier 29, into which a flexible plastic leaf 27 is inserted, is mounted in the lifting strip. The plastic leaf 27 is bent over and fixed in the leaf carrier 29 by a clamp strip 28. To this end, the clamp strip 28 is screwed to the leaf carrier 29.

Two doctor-blade holders 30 are attached to the housing 20 in the left and right external regions thereof. A doctor-blade leaf 31 is attached in each case between the filler piece 21 and the doctor-blade holders 30.

An engraved roll 4 is located above the application apparatus. The doctor-blade leaves 31 are arranged in such a way that they each limit a gap together with the engraved roll 4. On rotation of the engraved roll 4 in the clockwise direction, the gap between the right-hand doctor-blade leaf 31 and the engraved roll 4 functions as sealing gap, and the gap between the left-hand doctor-blade leaf 31 and the engraved roll 4 functions as exit gap. The plastic leaf 27 clamped between the leaf carrier 29 and the clamp strip 28 functions as dividing element, which divides the space limited by the surface of the engraved roll 4 and the two doctor-blade leaves 31 into a pre-chamber 7 and a main chamber 8.

The position of the plastic leaf relative to the surface of the engraved roll 4 can be adjusted vertically via the lifting strip 26. This enables, in particular, the contact pressure acting on the plastic leaf 27 to be set. The plastic leaf 27 thus produces effective separation between the pre-chamber 7 and the main chamber 8. The separating action is reinforced by the resilient properties of the plastic leaf 27.

In operation, the pre-chamber 7 and the main chamber 8 are filled with the medium via drilled holes (not shown). The pressure and temperature of the medium in the pre-chamber 7 and of the medium in the main chamber 8 can be set independently of one another. If medium from the pre-chamber 7 or the main chamber 8 enters the intermediate space between the clamp strip 28 and the engraved roll 4, it can flow out of this intermediate space via a drilled hole.

The position of the right-hand doctor-blade leaf 31 is selected in such a way that a small amount of the medium in the pre-chamber 7 constantly passes out of this chamber through the sealing gap. This forms a liquid barrier against ingressing air at the sealing gap. The exiting medium flows over the right-hand doctor-blade holder 30 into a trough (not shown) . The left-hand doctor-blade leaf is adjusted in such a way that, in combination with the other operating parameters, such as the pressure of the medium in the main chamber 8, its temperature, its viscosity, etc., the desired application thickness is achieved on the engraved roll 4.

The plastic leaf 27 is preferably made of a flexible plastic, such as polyester. Its thickness is preferably about 0.5 mm. By contrast, both the clamp strip 28 and the leaf carrier 29 preferably consist of a suitable metal alloy, as do the filler piece 21, the intermediate plate 22, the strip 23 and the side strips 24. The gasket between the side strips 24 and the lifting strip 26 is designed as an inflatable tubular gasket 25. It consists of a tube, preferably of silicone, which is filled with compressed air and thus achieves its sealing function.

Figure 4:
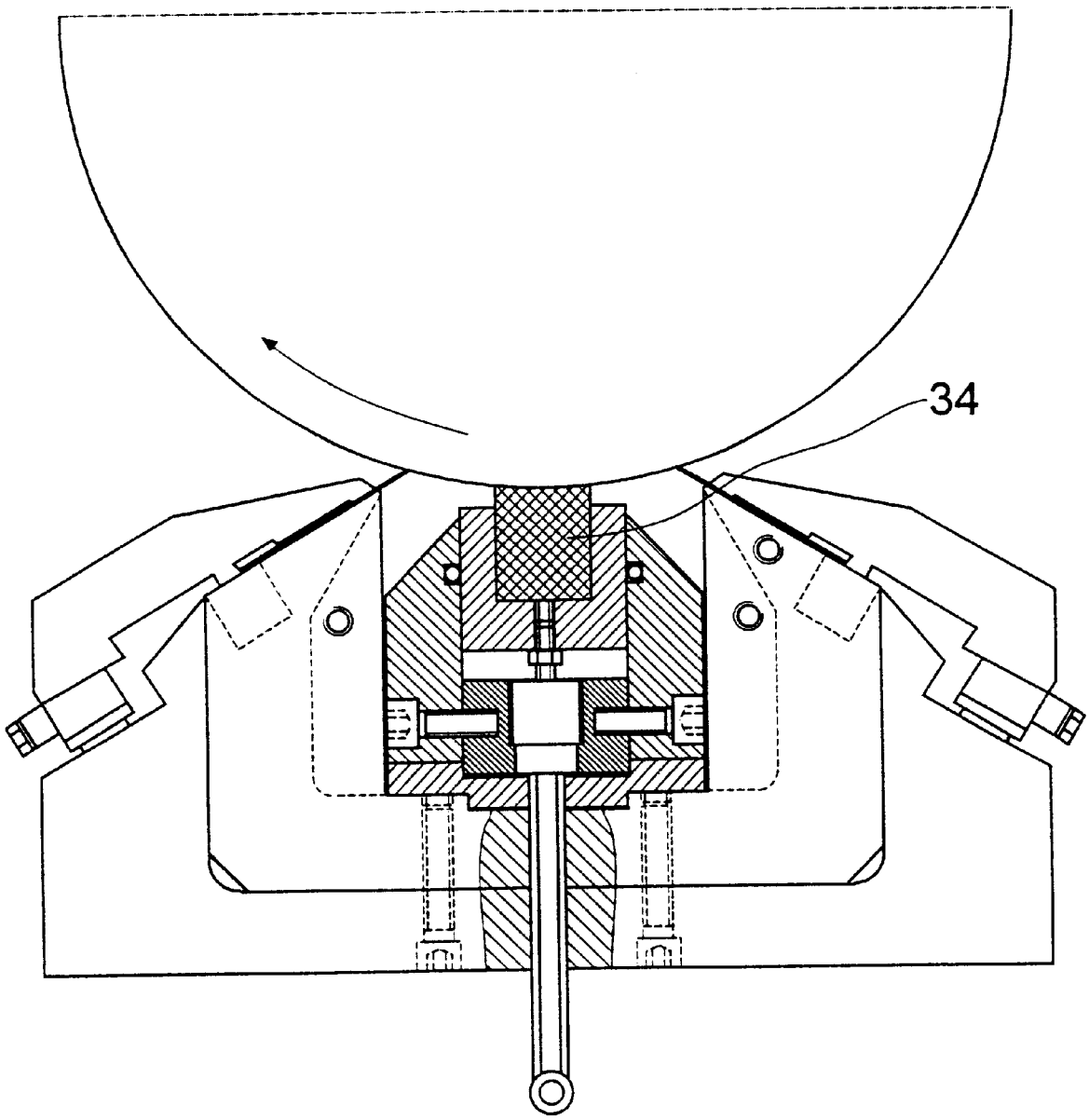

FIG. 4 shows a variant of an application apparatus according to the invention. Instead of a plastic leaf, a solid wiper 34 serves as sealing element between the pre-chamber 7 and the main chamber 8 here. The wiper is preferably made of polytetrafluoroethylene (PTFE). A wiper of this type can also ensure effective sealing between the pre-chamber 7 and the main chamber 8; significant material transfer does not occur between the pre-chamber 7 and the main chamber 8 or vice versa.

Figure 5:
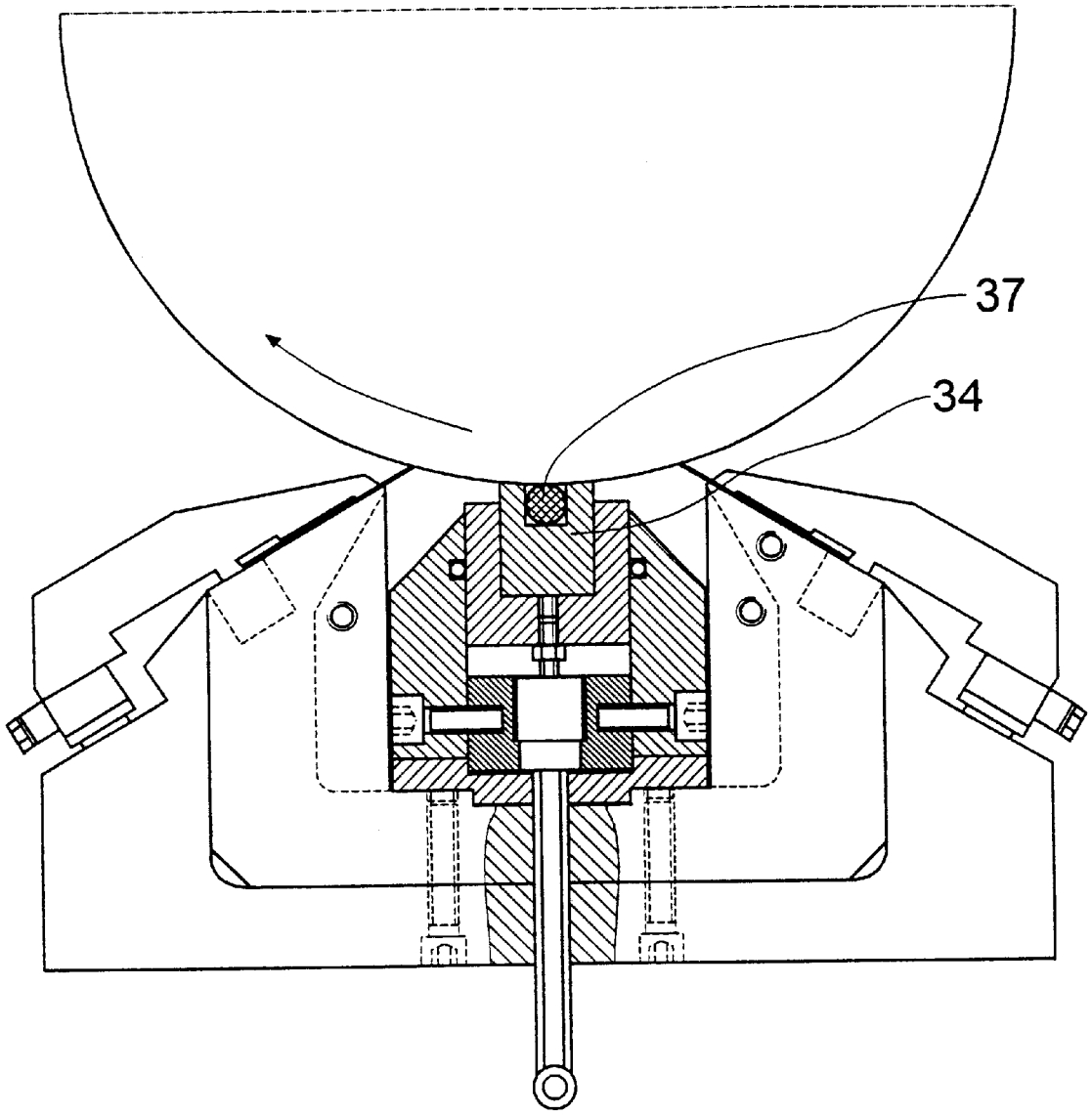

A further variant of the application apparatus is shown in FIG. 5. Here too, the dividing element between the pre-chamber 7 and the main chamber 8 contains a solid wiper 34. A cylindrical rod 37, which, like the wiper 34, is preferably made of PTFE, is additionally located in a recess of this wiper. Owing to the ability of the rod 37 to rotate, the friction between the engraved roll 34 and the dividing element is reduced. This also reduces wear of the dividing element. At the same time, the punctiform contact between the surface of the engraved roll 4 and the rod 37 ensures that a good sealing action is achieved.

FIG. 6 shows a further variant. In FIG. 6, the doctor-blade holder 30 and the doctor-blade leaves 31 are not shown, but are just as necessary in operation as in FIGS. 3 to 5. The dividing element between the pre-chamber 7 and the main chamber 8 has a multi-part construction here. It consists of two sealing strips 35 which taper to a point at the top and are separated by a spacer strip 36. A cylindrical rod 37 is inserted into the interspace between the surface of the engraved roll 4 and the spacer strip 36. This design results in very good separation between the pre-chamber 7 and the main chamber 8. Due to their shape tapering to a point at the top, the sealing strips 35 ensure reliable sealing, which is further reinforced by the rod 37.

Finally, a further variant of the application apparatus is shown in FIG. 7. Here too, two sealing strips 35 which taper to a point at the top are present, with a wiper 34 between them. This design enables, as indicated in FIG. 7, the provision of a run-off for the medium, which, if desired, runs from the pre-chamber 7 or the main chamber 8 into the interspace between the sealing strips 35.

FIG. 8 shows a front view of an application apparatus according to the invention as shown in one of FIGS. 3 to 7. FIG. 8 illustrates, in particular, the pneumatic connections for vertical movement of the lifting strip 26. For better clarity, the feed to the pre-chamber 7 and the main chamber 8 is not shown in FIG. 8. The lifting cylinders 41, which are connected to the lifting strip 26, which is not shown in FIG. 8, are provided with pneumatic connections 38. These are connected via T-pieces 40 and a pneumatic line 39. The lifting cylinders can be charged with compressed air in a controlled manner via this line. This enables the vertical position of the lifting strip 26 to be set precisely. A commercially available pneumatic apparatus is used for the provision of the compressed air for the pneumatic system. In another embodiment, the adjustment is instead carried out mechanically.

The pneumatic connection by means of which the tubular gaskets 25 are pressurized is also visible in FIG. 8. The end of a tubular gasket 25 projects out of the application apparatus to the right. A distributor 43, which is connected to a compressed-air supply 44, is attached to this end. The tubular gasket is provided with a sealing cap 45 at its left-hand end.

The entire apparatus shown in FIG. 8 is located in a trough (not shown) which collects medium exiting and overflowing from the sealing gap and returns it to the processing circuit.

The apparatuses described are used, in particular, in label manufacture in the coating of paper or film webs with adhesives. The adhesives can be of various types. For example, use is made of polymer melts which are applied to the web at elevated temperature and are then cooled. Rubber/resin mixtures and solutions of synthetic polymers are also widely used.

Dispersions are particularly important. In these, particles, preferably of a polymer, are dispersed in a dispersion medium, preferably water. After application of the dispersion to the web to be coated, the dispersion medium is removed in a drying unit, causing the particles to melt together and form the self-adhesive surface.

The dispersions used in label.manufacture are so-called contact adhesive dispersions, i.e. dispersions in which the film formation temperature of the dispersed polymer is below room temperature. The dispersed polymers used are in particular polymers based on (meth)acrylates and, to a lesser extent, vinyl ether polymers. Irrespective of the precise composition of the monomers, polymers of this type are pressure-sensitive and self-adhesive without additives being admixed with them. Preference is given here to so-called soft polymers, i.e. polymers having a low glass transition temperature.

Processes for the preparation of such polymers are adequately known to the person skilled in the art. A common process is so-called emulsion polymerization, in which polymerizable, olefinically unsaturated compounds (so-called monomers) are emulsified in water with the aid of surface-active compounds and polymerized with use of water-soluble initiators.

Of particular industrial importance are so-called main polymers selected from $C_1$–$C_{20}$-alkyl (meth)acrylates, vinyl esters of carboxylic acids containing up to 20 carbon atoms, vinylaromatic compounds having up to 20 carbon atoms, ethylenically unsaturated nitrites, vinyl halides, vinyl ethers of alcohols containing 1 to 10 carbon atoms, aliphatic hydrocarbons having 2 to 8 carbon atoms and 1 or 2 double bonds, or mixtures of these monomers.

Examples which may be mentioned are alkyl (meth)-acrylates containing a $C_1$–$C_{10}$-alkyl radical, such as methyl methacrylate, methyl acrylate, n-butyl acrylate, ethyl acrylate and 2-ethylhexyl acrylate. Mixtures of alkyl (meth) acrylates are also particularly suitable.

Vinyl esters of carboxylic acids having 1 to 20 carbon atoms are, for example, vinyl laurate, vinyl stearate, vinyl propionate, vinyl esters of Versatic acid and vinyl acetate.

Suitable vinylaromatic compounds are vinyltoluene, α- and p-methylstyrene, α-butylstyrene, 4-n-butylstyrene, 4-n-decylstyrene and preferably styrene. Examples of nitriles are acrylonitrile and methacrylonitrile.

The vinyl halides are chlorine-, fluorine- or bromine-substituted ethylenically unsaturated compounds, preferably vinyl chloride and vinylidene chloride.

Examples of vinyl ethers which may be mentioned are vinyl methyl ether and vinyl isobutyl ether. Preference is given to vinyl ethers of alcohols containing 1 to 4 carbon atoms.

As hydrocarbons having 2 to 8 carbon atoms and 2 olefinic double bonds, mention may be made of butadiene, isoprene and chloroprene.

Besides these main monomers, further monomers, for example hydroxyl-containing monomers, in particular $C_1$–$C_{10}$-hydroxyalkyl (meth)acrylates, (meth)acrylamide, ethylenically unsaturated acids, in particular carboxylic acids, such as (meth)acrylic acid or itaconic acid, dicarboxylic acids and their anhydrides or monoesters, for example maleic acid, fumaric acid and maleic anhydride, can be used in the polymer.

Conventional emulsion polymers generally comprise at least 40% by weight, preferably at least 60% by weight, particularly preferably at least 80% by weight, of the above main monomers. Particularly preferred main monomers are (meth)acrylates and vinylaromatic compounds, and mixtures thereof.

Aqueous polymer dispersions are generally used with solids contents of from 15 to 75% by weight, preferably from 40 to 60% by weight. The typical particle size of the dispersed polymer particles is in the range of from 150 to 3000 nm, preferably from 150 to 900 nm. The viscosity is typically in the range from 15 to 500 mPa s, preferably from 15 to 200 mPa s, at 23° C. in accordance with DIN EN ISO 3219 at a rate gradient of 100 l/s.

The application apparatus according to the invention as shown in FIG. 3 an enabled uniform application of aqueous polymer dispersions at a weight per unit area of between 10 and 30 g/m$^2$ to be achieved on siliconized paper or film at a surface speed of the engraved roll of between 250 and 600 m/min. The resultant adhesive film on the siliconized paper or on the film was of uniform, reproducible thickness and was free from air inclusions. In particular, the film had excellent transparency.

We claim:

1. An apparatus for applying a flowable medium (2, 2') to a continuously transported web (1) which lies on a counterroll (5) in a region where the medium (2, 2') is applied, comprising the following:

a) a continuously rotating engraved roll (4) adapted for applying medium (2, 2') to web (1), b) the engraved roll (4) has on its circumferential surface (6) a plurality of engraved grooves (19), c) an application head (3) adapted for applying medium (2, 2') to the circumferential surface (6) of the engraved roll (4), d) the application head (3) is arranged below the engraved roll (4), and the engraved roll (4) is arranged below the counter roll (5), e) the application head (3) has a pre-chamber (7) and a main chamber (8), open toward the circumferential surface (6) of the engraved roll (4), for the medium (2, 2') to be applied, f) the pre-chamber (7) and main chamber (8) are separated from one another by a center sealing member (10), with the sealing member (10) lying on the circumferential surface (6) of the engraved roll (4), g) the pre-chamber (7) is bounded on its exposed exterior side by a front doctor blade (13), which lies to form a seal on the circumferential surface (6) of the engraved roll (4) and the main chamber (8) is limited on its exposed exterior side by a back doctor blade (17) which also lies to form a seal on the circumferential surface (6) of the engraved roll (4), and h) pre-chamber (7) and main chamber (8) are adapted such that the pressure of the medium (2) in the pre-chamber (7) is greater than the pressure of the medium (2') in the main chamber (8).

2. Apparatus according to claim 1, wherein the sealing member (10) arranged between pre-chamber (7) and main chamber (8) is adjustable.

3. Apparatus according to claim 1, wherein the sealing member (10) is a solid wiper (34).

4. Apparatus according to claim 1, wherein the sealing member (10) has a flexible plastic leaf (27) that is arranged such that at least one edge of the leaf (27) makes contact with the circumferential surface (6) of the engraved roll (4).

5. Apparatus according to claim 1, wherein the pressure in the pre-chamber (7) is from about 300 mbar to 600 mbar, and the pressure in the main chamber (8) is from about 100 mbar to 300 mbar.

* * * * *